US010163397B2

(12) United States Patent
Son et al.

(10) Patent No.: US 10,163,397 B2
(45) Date of Patent: Dec. 25, 2018

(54) PIXEL UNIT AND DISPLAY APPARATUS HAVING THE PIXEL UNIT

(71) Applicant: Samsung Display Co., Ltd., Yongin-si, Gyeonggi-Do (KR)

(72) Inventors: Ho-Seok Son, Gwangmyeong-si (KR); Jin-Koo Chung, Suwon-si (KR); Jang-Mi Kang, Seoul (KR); Kyung-Hoon Kim, Uiwang-si (KR); Kyung-Ho Kim, Seoul (KR); Kwan-Ho Kim, Yongin-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 15/392,850

(22) Filed: Dec. 28, 2016

(65) Prior Publication Data

US 2017/0345371 A1 Nov. 30, 2017

(30) Foreign Application Priority Data

May 31, 2016 (KR) ..... 10-2016-0067068

(51) Int. Cl.
*G09G 3/32* (2016.01)
*G09G 3/3258* (2016.01)

(52) U.S. Cl.
CPC ... *G09G 3/3258* (2013.01); *G09G 2300/0426* (2013.01)

(58) Field of Classification Search
CPC ..... G09G 3/3258; G09G 2300/0426; G09G 2300/023; H01L 27/3267; H01L 2251/5315; H01L 2251/5323
See application file for complete search history.

(56) References Cited

U.S. PATENT DOCUMENTS

| | | | | |
|---|---|---|---|---|
| 7,199,520 | B2 * | 4/2007 | Fujii | H01L 27/3267 313/506 |
| 9,520,085 | B2 * | 12/2016 | Ko | G09G 3/3233 |
| 2015/0015468 | A1 * | 1/2015 | Ko | G09G 3/3233 345/82 |
| 2015/0161943 | A1 * | 6/2015 | Shim | G09G 3/3225 345/76 |
| 2017/0200415 | A1 * | 7/2017 | Noguchi | G09G 3/3258 |

FOREIGN PATENT DOCUMENTS

| | | |
|---|---|---|
| KR | 10-2015-0006729 A | 1/2015 |
| KR | 10-2016-0015775 A | 2/2016 |

* cited by examiner

*Primary Examiner* — Xuemei Zheng
(74) *Attorney, Agent, or Firm* — Innovation Counsel LLP

(57) ABSTRACT

A pixel unit includes a first organic light emitting diode for a front-side emission, a second organic light emitting diode for a back-side (both-sides) emission, and a pixel circuit configured to driver the first and second organic light emitting diodes. The pixel unit PU may include a pixel circuit, a first organic light emitting diode and a second organic light emitting diode.

20 Claims, 11 Drawing Sheets

PIXEL UNIT AND DISPLAY APPARATUS HAVING THE PIXEL UNIT

This application claims priority to and the benefit of Korean Patent Application No. 10-2016-0067068 filed on May 31, 2016, which is hereby incorporated by reference for all purposes as if fully set forth herein.

BACKGROUND

1. Field

Exemplary embodiments of the inventive concept relate to a pixel unit and a display apparatus having the pixel unit. More particularly, example embodiments of the inventive concept relate to a pixel unit for displaying on both-sides thereof and a display apparatus having the pixel unit.

2. Description of the Related Art

Recently, various flat panel display devices that reduce weight and volume have been developed. The flat panel display devices include a liquid crystal display (LCD) device, a field emission display (FED) device, a plasma display panel (PDP), an organic light emitting display (OLED) device, etc.

The OLED device has advantages such as rapid response speed and low power consumption because the OLED device displays an image using an organic light emitting diode that emits light based on recombination of electrons and holes.

SUMMARY

Exemplary embodiments of the inventive concept provide a pixel unit for displaying on both-sides thereof.

Exemplary embodiments of the inventive concept provide a display apparatus having the pixel unit.

According to an exemplary embodiment of the inventive concept, there is provided a pixel unit. The pixel unit includes a second organic light emitting diode for a back-side (both-sides) emission, and a pixel circuit configured to driver the first and second organic light emitting diodes, wherein the pixel circuit includes a first transistor comprising a control electrode connected to a first node, a first electrode connected to a second node and a second electrode connected to a third node, a capacitor comprising a first electrode connected to a first voltage line and a second electrode connected to the first node, a second transistor comprising a control electrode connected to a first scan line, a first electrode connected to a data line and a second electrode connected to the second node, a third transistor comprising a control electrode connected to the first scan line, a first electrode connected to the first node and a second electrode connected to the third node, a (5-1)-th transistor comprising a control electrode connected to a first emission line, a first electrode connected to the first voltage line and a second electrode connected to the second node, a (6-1)-th transistor comprising a control electrode connected to the first emission line, a first electrode connected to the third node and a second electrode connected to an anode electrode of the first organic light emitting diode, a (6-2)-th transistor comprising a control electrode connected to a second emission line, a first electrode connected to the third node and a second electrode connected to an anode electrode of the second organic light emitting diode, a (7-1)-th transistor comprising a control electrode connected to the first scan line, a first electrode connected to a second voltage line and a second electrode connected to an anode electrode of the first organic light emitting diode, and a (7-2)-th transistor comprising a control electrode connected to the first scan line, a first electrode connected to the second voltage line and a second electrode connected to an anode electrode of the second organic light emitting diode.

In an exemplary embodiment, the pixel circuit may further include a (5-2)-th transistor comprising a control electrode connected to the second emission line, a first electrode connected to the first voltage line and a second electrode connected to the second node.

In an exemplary embodiment, the pixel circuit may further include a fourth transistor comprising a control electrode connected to a second scan line, a first electrode connected to the first node and a second electrode connected to the second voltage line.

According to an exemplary embodiment of the inventive concept, there is provided a display apparatus. The display apparatus includes a display part comprising a first organic light emitting diode for a front-side emission, a second organic light emitting diode for a back-side (both-sides) emission, and a pixel circuit configured to drive the first and second organic light emitting diodes, a first emission driver configured to generate a first emission ON signal and a first emission OFF signal to turn-on and turn-off the first organic light emitting diode, a second emission driver configured to generate a second emission ON signal and a second emission OFF signal to turn-on and turn-off the second organic light emitting diode, a first selector configured to selectively output a first emission start signal and a first no-emission start signal to the first emission driver according to a selecting signal; and a second selector configured to selectively output a second emission start signal and a second no-emission start signal to the second emission driver according to the selecting signal.

In an exemplary embodiment, the display part may further include a transmission part transmitting a light.

In an exemplary embodiment, the first selector may be configured to provide the first emission driver with a first emission start signal, the second selector may be configured to provide the second emission driver with a second no-emission start signal, the first emission driver may be configured to provide a first emission line of the pixel circuit with a first emission ON signal corresponding to the first emission start signal, and the second emission driver may be configured to provide a second emission line of the pixel circuit with a second emission OFF signal corresponding to the second no-emission start signal, in response to the selecting signal for the front-side emission.

In an exemplary embodiment, the first selector may be configured to provide the first emission driver with a first no-emission start signal, the second selector may be configured to provide the second emission driver with a second emission start signal, the first emission driver may be configured to provide a first emission line of the pixel circuit with a first emission OFF signal corresponding to the first no-emission start signal, and the second emission driver may be configured to provide a second emission line of the pixel circuit with a second emission ON signal corresponding to the second emission start signal, in response to the selecting signal for the back-side (both-sides) emission.

In an exemplary embodiment, the first and second no-emission start signal may be direct current signals having a predetermined level and, the first and second emission OFF signals may be direct current signals having the predetermined level.

In an exemplary embodiment, each of the first and second emission drivers may includes a plurality of stages, the first selector may be disposed between a first stage of the first emission driver and a selecting signal line, and the second selector may be disposed between a first stage of the second emission driver and a selecting signal line.

In an exemplary embodiment, the display apparatus may further include a peripheral part surrounding the display part, the first and second emission drivers being disposed in the peripheral part, and a panel part comprising the display part and the peripheral part, wherein the first selector may be disposed in the peripheral part adjacent to the first emission driver and the second selector may be disposed in the peripheral part adjacent to the second emission driver.

In an exemplary embodiment, the display apparatus may further include a peripheral part surrounding the display part and a panel part comprising the display part and the peripheral part, and a connection circuit board connected to the panel part through a connection circuit film, wherein the first and second selectors may be disposed on the connection circuit board.

In an exemplary embodiment, the display apparatus may further include a main driver configured to provide the first and second selectors with an emission start signal, wherein the first and second emission start signals which are equal to the emission start signal may be respectively applied to the first and second emission drivers according to the selecting signal.

In an exemplary embodiment, the main driver may include a first gamma output part configured to output gamma data for the front-side emission, and a second gamma output part configured to output gamma data for the back-side (both-sides) emission, wherein the main driver may be configured to output input data into the gamma data corresponding to input data for the front-side or back-side (both-sides) emission using the first or second gamma output part.

In an exemplary embodiment, the first emission driver may be configured to provide the first emission line with a first emission OFF signal in response to a first no-emission start signal, and the second emission driver may be configured to provide the second emission line with a second emission OFF signal in response to a second no-emission start signal, during a black write period between a front-side emission mode and a back-side (both-sides) emission mode.

In an exemplary embodiment, the main driver may be configured to provide a data line of the pixel circuit with a black data voltage during the black write period.

In an exemplary embodiment, the black write period may include at least one frame.

In an exemplary embodiment, the first emission driver may be configured to provide the first emission line with a first emission ON signal in response to a first emission start signal and the second emission driver may be configured to provide the second emission line with a second emission ON signal in response to a second emission start signal, during a first period, and the first emission driver may be configured to provide the first emission line with a first emission OFF signal in response to a first no-emission start signal and the second emission driver may be configured to provide the second emission line with a second emission OFF signal in response to a second no-emission start signal, during a second period, wherein the first period alternates with the second period in an AOD (Always On Display) mode.

In an exemplary embodiment, each of the first and second periods may correspond to a single frame.

In an exemplary embodiment, the pixel circuit may include a first transistor comprising a control electrode connected to a first node, a first electrode connected to a second node and a second electrode connected to a third node, a capacitor comprising a first electrode connected to a first voltage line and a second electrode connected to the first node, a second transistor comprising a control electrode connected to a first scan line, a first electrode connected to a data line and a second electrode connected to the second node, a third transistor comprising a control electrode connected to the first scan line, a first electrode connected to the first node and a second electrode connected to the third node, a (5-1)-th transistor comprising a control electrode connected to a first emission line, a first electrode connected to the first voltage line and a second electrode connected to the second node, a (6-1)-th transistor comprising a control electrode connected to the first emission line, a first electrode connected to the third node and a second electrode connected to an anode electrode of the first organic light emitting diode and a (6-2)-th transistor comprising a control electrode connected to the second emission line, a first electrode connected to the third node and a second electrode connected to an anode electrode of the second organic light emitting diode.

In an exemplary embodiment, the pixel circuit may further include a (5-2)-th transistor comprising a control electrode connected to the second emission line, a first electrode connected to the first voltage line and a second electrode connected to the second node.

In an exemplary embodiment, wherein the pixel circuit may further include a (7-1)-th transistor comprising a control electrode connected to the first scan line, a first electrode connected to a second voltage line and a second electrode connected to the anode electrode of the first organic light emitting diode, and a (7-2)-th transistor comprising a control electrode connected to the first scan line, a first electrode connected to the second voltage line and a second electrode connected to the anode electrode of the second organic light emitting diode.

In an exemplary embodiment, wherein the pixel circuit may further include a fourth transistor comprising a control electrode connected to a second scan line, a first electrode connected to the first node and a second electrode connected to the second voltage line.

In an exemplary embodiment, the (5-1)-th and (6-1)-th transistors may turn on and turn off in response to a first emission ON signal and a first emission OFF signal generated from the first emission driver.

In an exemplary embodiment, the (5-2)-th and (6-2)-th transistors may turn on and turn off in response to a second emission ON signal and a second emission OFF signal generated from the second emission driver.

According to the inventive concept, the display apparatus may separately drive the pixels for the front-side emission and the back-side (both-sides) emission according to the selecting signal. In addition, a gamma curve may be altered according to the front-side emission mode and the back-side (both-sides) emission mode, and thus luminance of a front-side image and a back-side (both-sides) image may be improved. In addition, the black write period may be inserted between the front-side and back-side (both-sides) emission modes, and thus, the crosstalk between the front-side and back-side (both-sides) images may be avoided. In addition, in the always on display (AOD) mode, the front-side emission mode and the back-side (both-sides) emission mode are alternately driven by the predetermined period and thus, the afterimage may be eliminated.

BRIEF DESRCIPTION OF THE DRAWINGS

The above and other features and advantages of the inventive concept will become more apparent by describing in detailed exemplary embodiments thereof with reference to the accompanying drawings, in which.

DETAILED DESCRIPTION OF THE INVENTION

Hereinafter, the inventive concept will be explained in detail with reference to the accompanying drawings.

Figure 1:
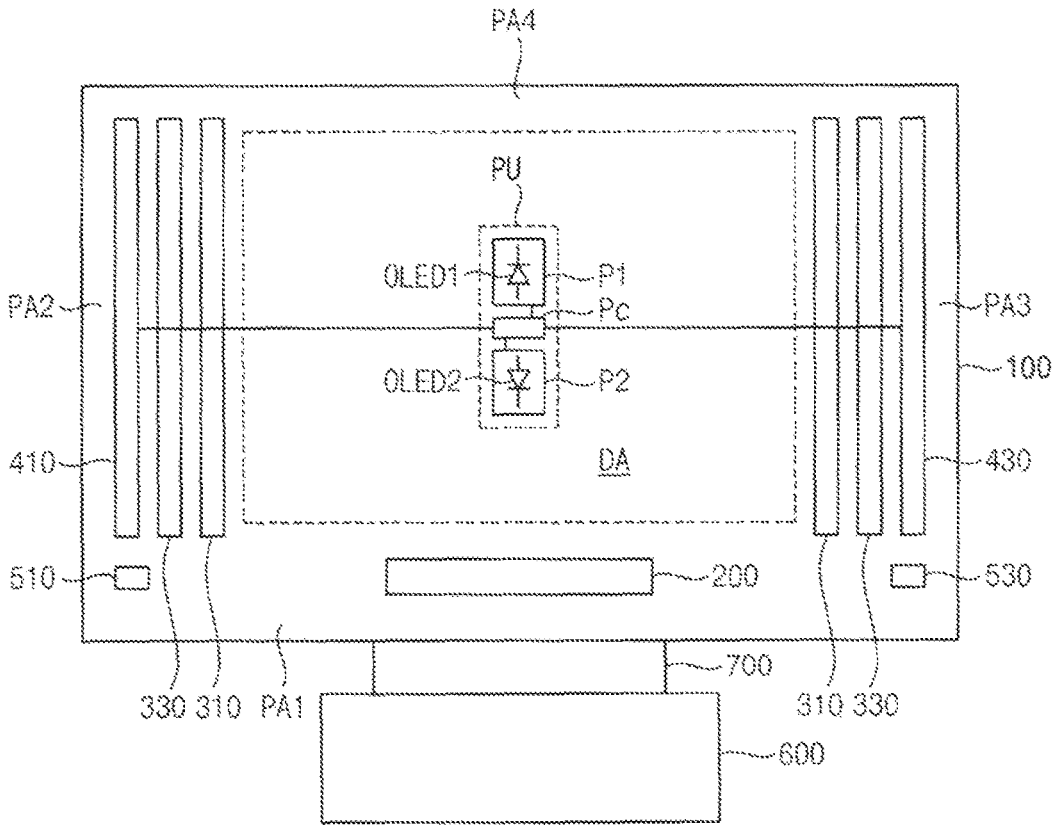
FIG. 1 is a conceptual diagram illustrating a display apparatus according to an exemplary embodiment.

FIG. 1 is a conceptual diagram illustrating a display apparatus according to an exemplary embodiment.

Referring to FIG. 1, the display apparatus may include a panel part 100, a main driver 200, a first scan driver 310, a second scan driver 330, a first emission driver 410, a second emission driver 430, a first selector 510, a second selector 530, a connection circuit board 600 and a connection circuit film 700.

The panel part 100 may include a display part DA and a peripheral part surrounding the display part DA.

The display part DA may include a pixel unit PU which is configured to display a front-side image and a back-side (both-sides) image. The pixel unit PU may include a front-side pixel P1, a back-side (both-sides) pixel P2 and a pixel circuit Pc. The pixel unit PU may further include a transmission part which transmits a light, and the transmission part may correspond to the back-side (both-sides) pixel P2. The front-side pixel P1 may include a first organic light emitting diode OLED1 for a front-side emission, which is configured to display an image on a first-side that is a front-side of the display part DA. The front-side pixel P1 may be configured to display an image on the front-side of the display part DA.

The back-side (both-sides) pixel P2 may include a second organic light emitting diode OLED2 for a back-side (both-sides) emission, which is configured to display an image on a second-side opposite to the first-side that is a back-side of the display part DA. The back-side (both-sides) pixel P2 may be configured to display an image on the back-side of the display part DA. Alternatively, the back-side (both-sides) pixel P2 may be configured to display an image on the front-side and the back-side of the display part DA.

The pixel circuit Pc may be configured to separately drive the first organic light emitting diode OLED1 of the front-side pixel P1 and the second organic light emitting diode OLED2 of the back-side (both-sides) pixel P2.

The peripheral part may include a first area PA1, a second area PA2, a third area PA3 and a fourth area PA4 respectively disposed on the peripheral part adjacent to four-sides of the display part DA.

The main driver 200 may be disposed in the first area PA1 and configured to generally drive the display apparatus.

For example, the main driver 200 is configured to generate a plurality of first driving signals for controlling the first scan driver 310, a plurality of second driving signals for controlling the second scan driver 330, a plurality of third driving signals for controlling the first emission driver 410 and a plurality of fourth driving signals for controlling the second emission driver 430. The plurality of first driving signals may include a first scan start signal for starting an operation of the first scan driver 310 and a plurality of first scan-clock signals. The plurality of second driving signals may include a second scan start signal for starting an operation of the second scan driver 330 and a plurality of second scan-clock signals. The plurality of third driving signals may include a first start signal for starting an operation of the first emission driver 410 and a plurality of first emission clock signals. The first start signal may include a first emission start signal and a first no-emission start signal. The plurality of fourth driving signals may include a second start signal for starting an operation of the second emission driver 430 and a plurality of second emission clock signals. The second start signal may include a second emission start signal and a second no-emission start signal.

The first scan driver 310 is configured to provide the pixel circuit Pc with a first scan signal. The first scan driver 310 is disposed in the second area PA2 and configured to provide a plurality of first scan lines in the display part DA with a plurality of first scan signals. The first scan driver 310 may be disposed in the second area PA2 and a third area PA3 opposite to the second area PA2 to form a dual-bank structure. The first scan signal may be a write control signal which controls a data voltage corresponding to the pixel unit PU to be written in the pixel circuit Pc. The first scan signal may be applied to an n-th scan line SLn referring to the pixel unit shown in FIG. 2.

The second scan driver 330 is configured to provide the pixel circuit Pc with a second scan signal. The second scan driver 330 is disposed in the second area PA2, and configured to provide a plurality of second scan lines in the display part DA with a plurality of second scan signals. The second scan driver 330 may be disposed in the second area PA2 and the third area PA3 opposite to the second area PA2 to form a dual-bank structure. The second scan signal may be an initialization control signal which controls the pixel circuit Pc to be initialized the pixel circuit Pc. The second scan signal may be applied to an (n−1)-th scan line SLn-1 referring to the pixel unit shown in FIG. 2.

The first emission driver 410 is configured to generate a first emission ON signal which turns on the first organic light emitting diode OLED1 of the front-side pixel P1 and a first emission OFF signal which turns off the first organic light emitting diode OLED1 of the front-side pixel P1. The first emission driver 410 is disposed in the second area PA2 and connected to a plurality of first emission lines in the display part DA.

The second emission driver 430 is configured to generate a second emission ON signal which turns on the second organic light emitting diode OLED2 of the back-side (both-sides) pixel P2 and a second emission OFF signal which turns off the second organic light emitting diode OLED2 of the back-side (both-sides) pixel P2. The second emission driver 430 is disposed in the third area PA3, and connected to a plurality of second emission lines in the display part DA.

The first selector 510 is configured to provide the first emission driver 410 with a first start signal for starting an operation of the first emission driver 410 in response to a selecting signal which is received from an external device and selects an emission-side. The first selector 510 may be disposed in the first area PA1 and disposed between the external device and the first emission driver 410.

For example, when the selecting signal having a first level is received, the first selector 510 is configured to provide the first emission driver 410 with the first emission start signal, and when the selecting signal having a second level is received, the first selector 510 is configured to provide the first emission driver 410 with a first no-emission start signal.

The second selector 530 is configured to provide the second emission driver 430 with a second start signal for starting an operation of the second emission driver 430 in response to the selecting signal which is received from an external device and selects an emission-side. The second selector 530 may be disposed in the first area PA1 and disposed between the external device and the second emission driver 430.

For example, when the selecting signal having the second level is received, the second selector 530 is configured to provide the second emission driver 430 with a second emission start signal, and when the selecting signal having the first level is received, the second selector 530 is configured to provide the second emission driver 430 with a second no-emission start signal.

The connection circuit board 600 may include a connector which connects the panel part 100 and the external device (Not shown).

The connection circuit film 600 may connect the connection circuit board 500 and the panel part 100.

According to the exemplary embodiment, the pixel circuit Pc may be configured to separately drive the front-side pixel P1 and the back-side (both-sides) pixel P2 of the pixel unit PU based on the selecting signal which is received from the external device and selects an emission-side.

Figure 2:
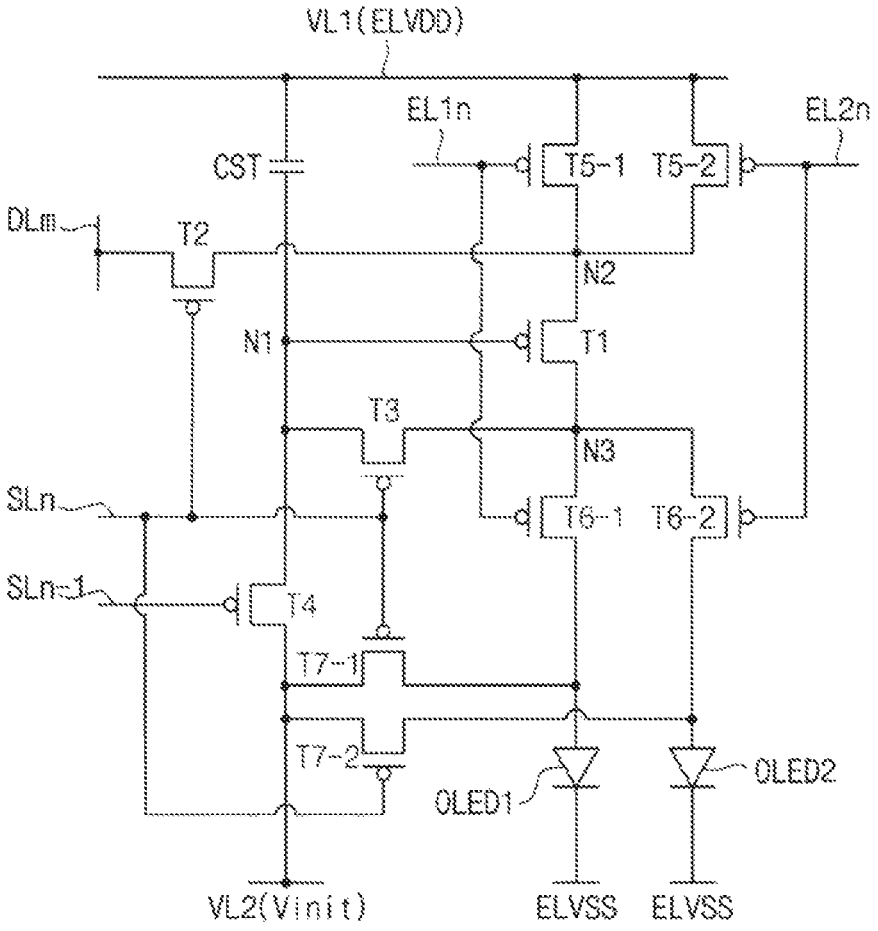
FIG. 2 is a circuit diagram illustrating a pixel unit according to an exemplary embodiment.

FIG. 2 is a circuit diagram illustrating a pixel unit according to an exemplary embodiment.

Referring to FIGS. 1 and 2, the pixel unit PU may include a pixel circuit Pc, a first organic light emitting diode OLED1 and a second organic light emitting diode OLED2. The pixel circuit Pc may include a first transistor T1, a capacitor CST, a second transistor T2, a third transistor T3, a fourth transistor T4, a (5-1)-th transistor T5-1, a (5-2)-th transistor T5-2, a (6-1)-th transistor T6-1, a (6-2)-th transistor T6-2 and a (7-1)-th transistor T7-1 and a (7-2)-th transistor T7-2.

In the exemplary embodiment, the transistors may be a P-type transistor which turns on when a control electrode receives a voltage of a low level and turns off when the control electrode receives a voltage of a high level. Alternatively, the transistors may be an N-type transistor which turns on when the control electrode receives a voltage of a high level and turns off when the control electrode receives a voltage of a low level.

The pixel circuit Pc may further include a data line DLm, a first scan line SLn, a second scan line SLn-1, a first emission line EL1*n*, a second emission line ELn2, a first voltage line VL1 and a second voltage line VL2.

The first transistor T1 may include a control electrode connected to a first node N1, a first electrode connected to a second node N2 and a second electrode connected to a third node N3.

The capacitor CST may include a first electrode connected to a first voltage line VL1 and a second electrode connected to the first node N1. The first voltage line VL1 may receive a first power source voltage ELVDD.

The second transistor T2 may include a control electrode connected to a first scan line SLn, a first electrode connected to the data line DLm and a second electrode connected to the second node N2. The data line DLm may transfer a data voltage to the pixel unit PU.

The third transistor T3 may include a control electrode connected to the first scan line SLn, a first electrode connected to the first node N1 and a second electrode connected to a third node N3. The first scan line SLn may receive an n-th scan signal from the first scan driver 310.

The fourth transistor T4 may include a control electrode connected to a second scan line SLn-1, a first electrode connected to the first node N1 and a second electrode connected to a second voltage line VL2. The second scan line SLn-1 may transfer an (n−1)-th scan signal, and the second voltage line VL2 may receive an initial voltage Vinit.

The (5-1)-th transistor T5-1 may include a control electrode connected to a first emission line EL1*n*, a first electrode connected to the first voltage line VL1 and a second electrode connected to the second node N2. The first emission line EL1*n* may receive the first emission ON signal or the first emission OFF signal from the first emission driver 410. The (5-1)-th transistor T5-1 may turn on or off in response to the first emission ON signal or the first emission OFF signal.

The (5-2)-th transistor T5-2 may include a control electrode connected to a second emission line ELn2, a first electrode connected to the first voltage line VL1 and a second electrode connected to the second node N2. The second emission line ELn2 may receive the second emission ON signal or the second emission OFF signal from the second emission driver 430. The (5-2)-th transistor T5-2 may turn on or off in response to the second emission ON signal or the second emission OFF signal.

The (6-1)-th transistor T6-1 may include a control electrode connected to a first emission line EL1*n*, a first electrode connected to the third node N3 and a second electrode connected to an anode electrode of the first organic light emitting diode OLED1. The (6-1)-th transistor T6-1 may turn on or off in response to the first emission ON signal or the first emission OFF signal.

The (6-2)-th transistor T6-2 may include a control electrode connected to a second emission line ELn2, a first electrode connected to the third node N3 and a second electrode connected to an anode electrode of the second organic light emitting diode OLED2. The (6-2)-th transistor T6-2 may turn on or off in response to the second emission ON signal or the second emission OFF signal.

The (7-1)-th transistor T7-1 may include a control electrode connected to a first scan line SLn, a first electrode connected to the second voltage line VL2 and a second electrode connected to an anode electrode of the first organic light emitting diode OLED1.

The (7-2)-th transistor T7-2 may include a control electrode connected to a first scan line SLn, a first electrode connected to the second voltage line VL2 and a second electrode connected to an anode electrode of the second organic light emitting diode OLED2.

Although not shown, at least one of the third transistor T3 and the fourth transistor T4 may have a dual-gate structure to avoid leakage current.

Figure 3:
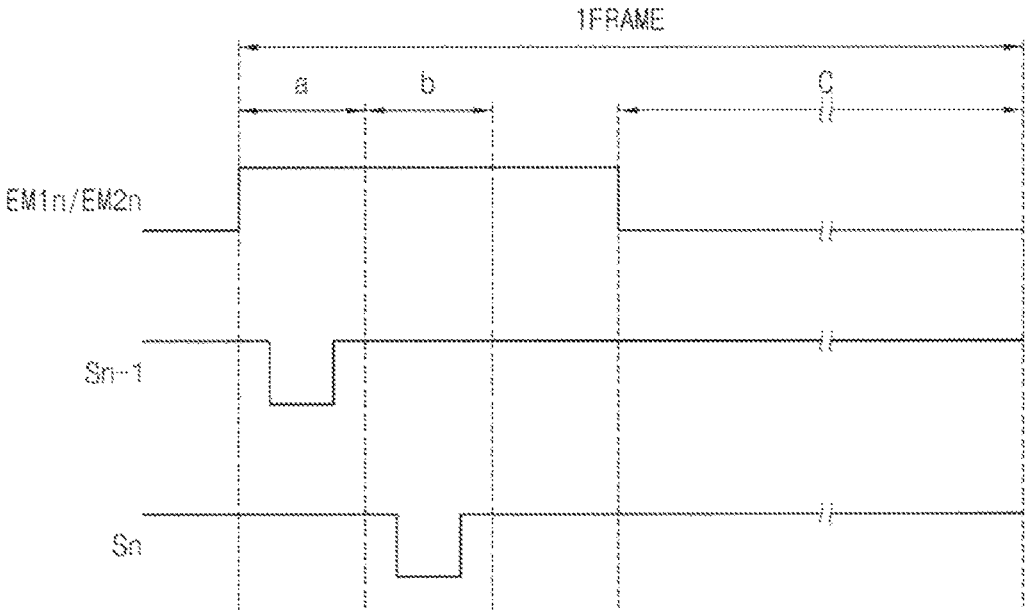
FIG. 3 is a timing chart illustrating a method of driving the pixel unit according to an exemplary embodiment.

FIG. 3 is a timing chart illustrating a method of driving the pixel unit according to an exemplary embodiment.

Referring to FIGS. 2 and 3, during a first period a of a frame period, the fourth transistor T4 turns on and remaining transistors T1, T2, T3, T5-1, T5-2, T6-1, T6-2, T7-1 and T7-2 turn off in response to a low level of the (n−1)-th scan signal Sn-1 applied to the second scan line SLn-1. Thus, a previous data voltage charged in the capacitor CST may be initialized by the initial voltage Vinit applied to the second voltage line VL2.

During a second period b of the frame period, the second, third, (7-1)-th and (7-2)-th transistors T2, T3, T7-1 and T7-2 turn on and remaining transistors T1, T5-1, T5-2, T6-1 and T6-2 turn off in response to the low level of the n-th scan signal Sn applied to the first scan line SLn.

Therefore, the third transistor T3 turns on and thus the first transistor T1 is diode-coupled. A data voltage transferred through the data line DLm is applied to the second node N2. A difference voltage between a voltage Vdata of the second node N2 and a threshold voltage Vth of the first transistor T1 is applied to the first node N1. The first transistor T1 is the P-type transistor and thus, the threshold voltage Vth may be a negative voltage. Therefore, the difference voltage between the voltage Vdata corresponding to the data voltage and an absolute-value of the threshold voltage Vth is applied to the first node N1 and thus, the threshold voltage of the first transistor T1 may be compensated.

In addition, the capacitor CST may charge the voltage corresponding to the data voltage Vdata.

In addition, the (7-1)-th transistor T7-1 and the (7-2)-th transistor T7-2 are turned on and then the initial voltage Vinit is applied to the anode electrodes of the first and second organic light emitting diodes OLED1 and OLED. Thus, the anode electrodes of the first and second organic light emitting diodes OLED1 and OLED2 may be initialized by the initial voltage Vinit.

As described above, during the second period b of the frame period, the threshold voltage of the first transistor T1 may be compensated, the voltage Vdata corresponding to the data voltage may be charged in capacitor CST, and the anode electrodes of the first and second organic light emitting diodes OLED1 and OLED2 may be initialized.

During a third period c of the frame period, the low level of the n-th emission ON signal is applied to a first emission line EL1*n* and a high level of the emission OFF signal is applied to the second emission line ELn2. Then, the (5-1)-th and (6-1)-th transistors T5-1 and T6-1 are turned on, the (5-2)-th and (6-2)-th transistors T5-2 and T6-3 are turned off. In addition, remaining transistors T1, T2, T3, T4, T7-1 and T7-2 are turned off.

Therefore, the first transistor T1 turns on in response to the voltage Vdata corresponding to the data voltage charged in the capacitor CST and then, a driving current corresponding to the data voltage may flow through the first organic light emitting diode OLED1. Thus, the first organic light emitting diode OLED1 may emit the light and the front-side image may be displayed.

However, during the third period c of the frame period, a high level of the emission OFF signal is applied to the first emission line EL1*n* and a low level of the emission ON signal is applied to the second emission line ELn2. Then, the (5-1)-th and (6-1)-th transistors T5-1 and T6-1 are turned off, the (5-2)-th and (6-2)-th transistors T5-2 and T6-3 are turned on and remaining transistors T1, T2, T3, T4, T7-1 and T7-2 are turned off.

Therefore, the first transistor T1 turns on in response to the voltage Vdata corresponding to the data voltage charged in the capacitor CST and then, a driving current corresponding to the data voltage may flow through the second organic light emitting diode OLED2. Thus, the second organic light emitting diode OLED2 may emit the light and the back-side (both-sides) image may be displayed.

Figure 4:
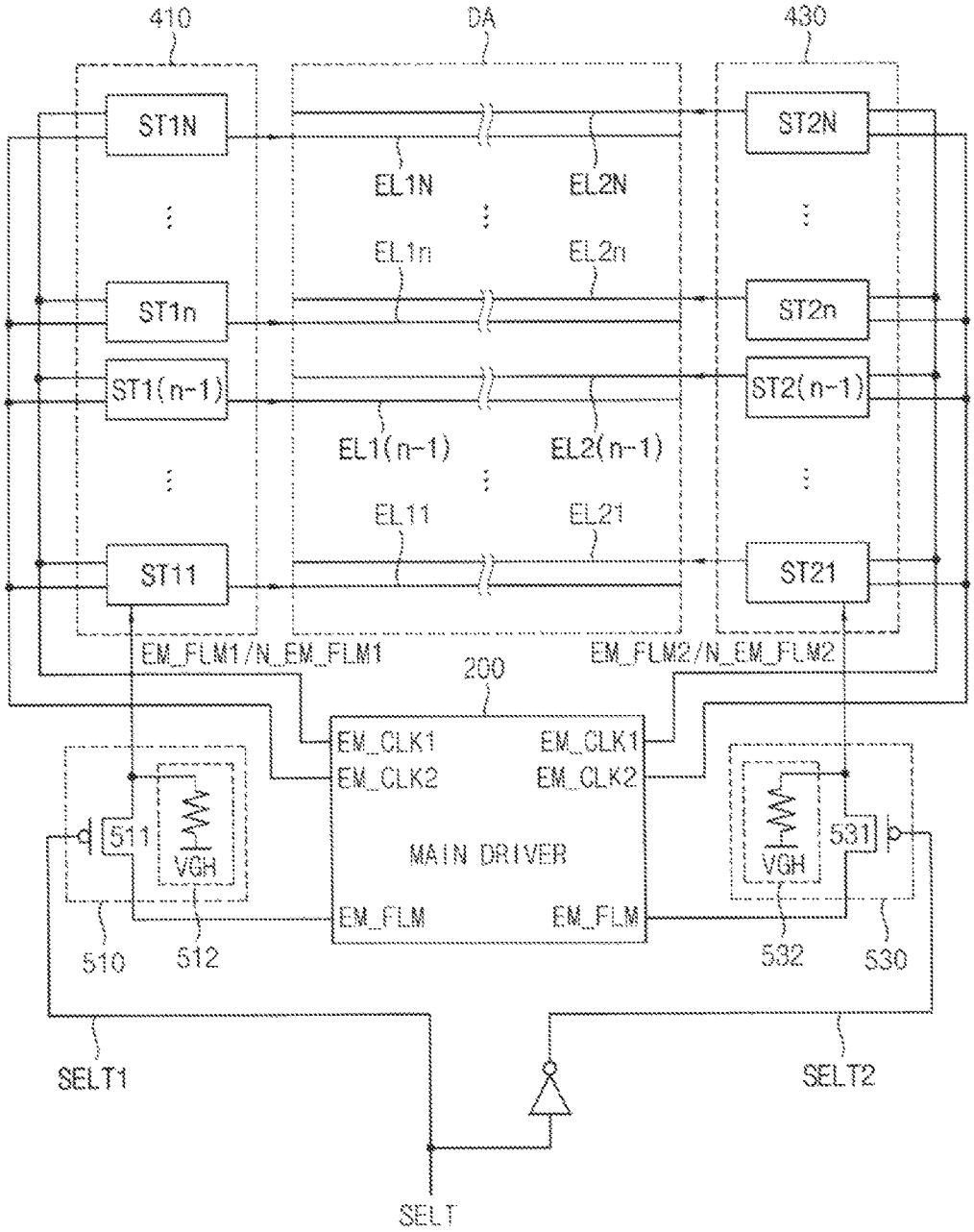
FIG. 4 is a block diagram illustrating a display apparatus according to an exemplary embodiment.

FIG. 4 is a block diagram illustrating a display apparatus according to an exemplary embodiment.

Referring to FIGS. 1 and 4, the display apparatus may include a main driver 200, a first emission driver 410, a second emission driver 430, a first selector 510 and a second selector 530.

The main driver 200 is configured to generate an emission start signal EM_FLM, a first clock signal EM_CLK1 and a second clock signal EM_CLK2 for driving the first and second emission drivers 410 and 430.

The first selector 510 may include a first switch 511 and a first signal generator 512. The first switch 511 and the first signal generator 512 may be formed in the panel part 100 via the process substantially the same as that forming the pixel circuit.

The first switch 511 is configured to provide the first emission driver 410 with the first emission start signal EM_FLM1 equal to the emission start signal EM_FLM in response to the selecting signal SELT received from the external device. The selecting signal SELT may be provided through a selecting signal line. The first signal generator 512 is configured to provide the first emission driver 410 with the first no- emission start signal N_EM_FLM1 which is a direct current signal having a high level VGH in response to the first selecting signal SELT1. The first signal generator 512 may use a high level VGH generated from a voltage generator in the main driver 200.

The second selector 530 may include a second switch 531 and a second signal generator 532. The second switch 531 and the second signal generator 532 may be formed in the panel part 100 via the process substantially the same as that forming the pixel circuit.

The second switch 531 is configured to provide the second emission driver 430 with the second emission start signal EM_FLM2 equal to the emission start signal EM_FLM in response to a second selecting signal SELT2 having a phase opposite to the selecting signal SELT received from the external device. The second signal generator 532 is configured to provide the second emission driver 430 with the second no-emission start signal N_EM_FLM2 which is a direct current signal having a high level VGH in response to the second selecting signal SELT2. The second signal generator 532 may use a high level VGH generated from a voltage generator in the main driver 200.

When the first level (e.g., low level) of the selecting signal SELT which selects the front-side emission is received from the external device, the first selector 510 is configured to receive the low level of the first selecting signal SELT1 equal to the low level of the selecting signal SELT. The first switch 511 is turned on in response to the low level of the first selecting signal SELT1. Therefore, the first switch 511 is configured to provide the first emission driver 410 with the first emission start signal EM_FLM1 equal to the emission start signal EM_FLM. The first emission driver 410 is configured to generate a plurality of first emission ON signals in response to the first emission start signal EM_FLM1.

However, when the second level (e.g., high level) of the selecting signal SELT which does not select the front-side emission is received from the external device, the first selector 510 is configured to receive the low level of the first selecting signal SELT1 equal to the high level of the selecting signal SELT. The first switch 511 is turned off in response to the high level of the first selecting signal SELT1.

Therefore, the first signal generator 512 is configured to provide the first emission driver 410 with the high level VGH of the first no-emission start signal N_EM_FLM1. The first emission driver 410 is configured to generate a plurality of first emission OFF signals in response to the first no-emission start signal N_EM_FLM1.

When the low level of the selecting signal SELT which selects the front-side emission is received from the external device, the second selector 530 is configured to receive the high level of the second selecting signal SELT2 opposite to the low level of the selecting signal SELT. The second switch 531 is turned off in response to the high level of the second selecting signal SELT2. Therefore, the second signal generator 532 is configured to provide the second emission driver 430 with the high level VGH of the second no-emission start signal N_EM_FLM2. The second emission driver 430 is configured to generate a plurality of second emission OFF signals in response to the second no-emission start signal N_EM_FLM2.

However, when the high level of the selecting signal SELT which does not select the front-side emission is received from the external device, the second selector 530 is configured to receive the low level of the second selecting signal SELT2 opposite to the high level of the selecting signal SELT. The second switch 531 is turned on in response to the low level of the second selecting signal SELT2. Therefore, the second switch 531 is configured to provide the second emission driver 430 with the second emission start signal EM_FLM2 equal to the emission start signal EM_FLM. The second emission driver 430 is configured to generate a plurality of second emission ON signals in response to the second emission start signal EM_FLM2.

The first emission driver 410 may include a plurality of first stages ST11, . . . , ST1 *n*-1, ST1*n*, . . . , ST1N, and the plurality of first stages ST11, . . . , ST1 *n*-1, ST1*n*, . . . , ST1N may be respectively connected to a plurality of first emission lines EL11, . . . , EL1 *n*-1, EL1*n*, . . . , EL1N in the display part DA. Each first emission line may be connected to a plurality of pixel circuits in corresponding horizontal line.3

The plurality of first stages ST11, . . . , ST1 *n*-1, ST1 *n*-1, . . . , ST1N is configured to sequentially output a plurality of first emission ON signals in synchronization with a first clock signal EM_CLK1 and a second clock signal EM_CLK2 in response to the first emission start signal EM_FLM1. In addition, the plurality of first stages ST11, . . . , ST1 *n*-1, ST1 *n*-1, . . . , ST1N is configured to output a plurality of emission OFF signals which is a direct current signal having the high level VGH in response to the first no-emission start signal N_EM_FLM1.

The second emission driver 430 may include a plurality of second stages ST21, . . . , ST2 *n*-1, ST2*n*, . . . , ST2N and the plurality of second stages ST21, . . . , ST2 *n*-1, ST2 *n*, . . . , ST2N may be respectively connected to a plurality of second emission lines EL21, . . . , EL2 *n*-1, EL2*n*, . . . , EL2N in the display part DA. Each second emission line may be connected to a plurality of pixel circuits in corresponding horizontal line.

The plurality of second stages ST21, . . . , ST2 *n*-1, ST2 *n*, . . . , ST2N is configured to sequentially output a plurality of second emission ON signals in synchronization with a first clock signal EM_CLK1 and a second clock signal EM_CLK2 in response to the second emission start signal EM_FLM2. In addition, the plurality of second stages ST 21, . . . , ST2 *n*-1, ST2*n*, . . . , ST2N is configured to output a plurality of emission OFF signals which is a direct current signal having the high level VGH in response to the second no-emission start signal N_EM_FLM2.

Figure 5:
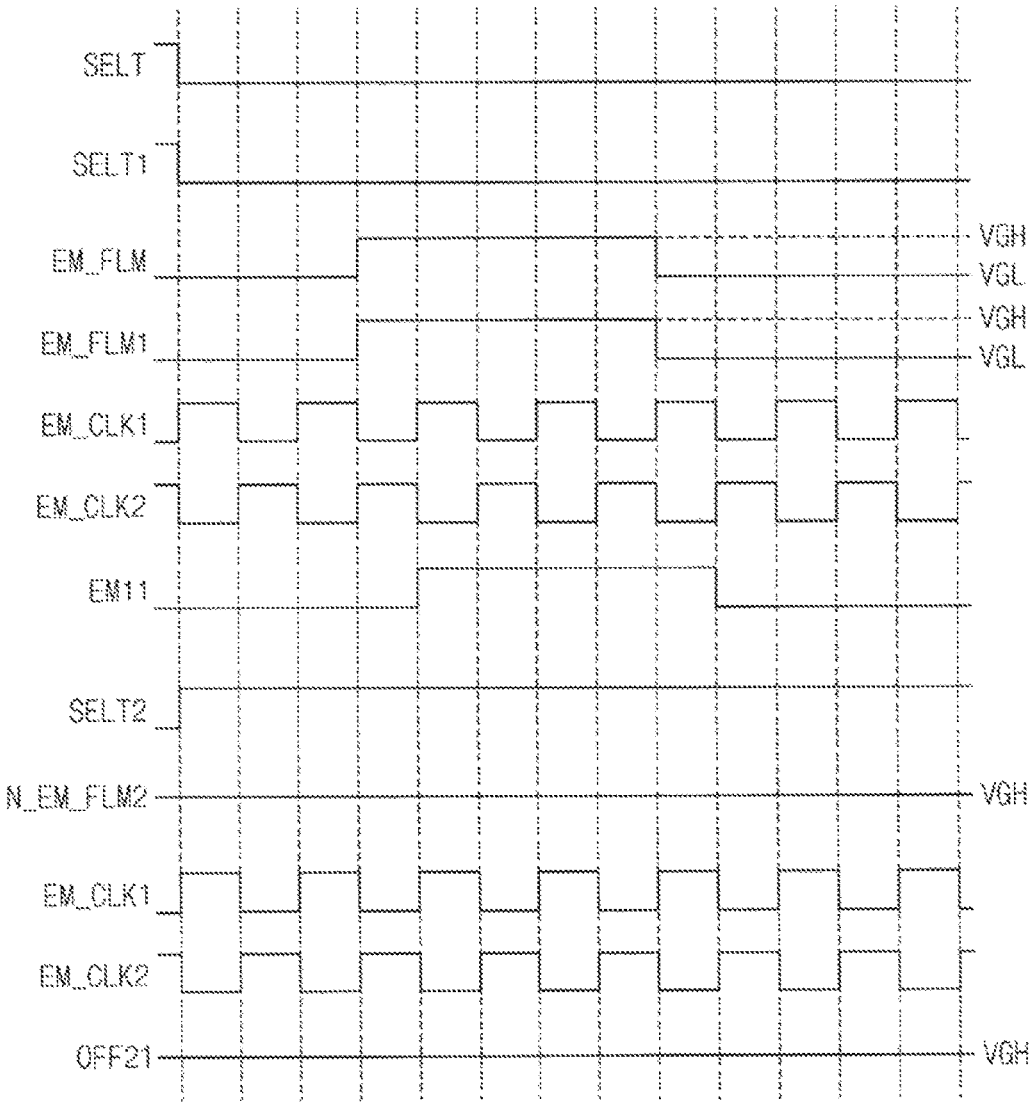
FIG. 5 is a timing chart illustrating a method of driving an emission driver in a front-side emission mode according to an exemplary embodiment.

FIG. 5 is a timing chart illustrating a method of driving an emission driver in a front-side emission mode according to an exemplary embodiment.

Referring to FIGS. 4 and 5, when the low level of the selecting signal SELT which selects the front-side emission is received from the external device, the first selector 510 is configured to receive the low level of the first selecting signal SELT1 equal to the low level of the selecting signal SELT.

The first selector 510 is configured to provide the first emission driver 410 with the first emission start signal EM_FLM1 which is equal to the emission start signal EM_FLM received from the main deriver 200.

The plurality of first stages ST11, . . . , ST1 *n*-1, ST1 *n*-1, . . . , ST1N of the first emission driver 410 is configured to generate a plurality of first emission ON signals EM 11, . . . in synchronization with the first clock signal EM_CLK1 and the second clock signal EM_CLK2 in response to the first emission start signal EM_FLM1 and to sequentially output the plurality of first emission ON signals EM11, . . . to the plurality of first emission lines.

When the low level of the selecting signal SELT is received from the external device, the second selector 530 is configured to receive the high level of the second selecting signal SELT2 opposite to the low level of the selecting signal SELT. The second selector 530 is configured to provide the second emission driver 430 with the high level VGH of the second no-emission start signal N_EM_FLM2 in response to the high level of the second selecting signal SELT2. The second emission driver 430 is configured to generate a plurality of second emission OFF signals OFF 21, . . . having the high level VGH in response to the second no-emission start signal N_EM_FLM2 and to simultaneously output the plurality of second emission OFF signals OFF21, . . . to the plurality of second emission lines.

Referring to the pixel circuit shown in FIG. 2, the first emission ON signal received from the first emission driver 410 is applied to the control electrodes of the (5-1)-th and (6-1)-th transistors T5-1 and T6-1. The second emission OFF signal received from the second emission driver 430 is applied to the control electrodes of the (5-2)-th and (6-2)-th transistors T5-2 and T6-2. The (5-1)-th and (6-1)-th transistors T5-1 and T6-1 are turned on in response to the first emission ON signal, and the (5-2)-th and (6-2)-th transistors T5-2 and T6-2 are turned off in response to the second emission OFF signal.

Therefore, a driving current corresponding to the data voltage may flow through the first organic light emitting diode OLED1 for the front-side emission by turned-on (5-1)-th and (6-1)-th transistors T5-1 and T6-1 and thus, the first organic light emitting diode OLED1 for the front-side emission may emit the light. However, a driving current may not flow through the second organic light emitting diode OLED2 for the back-side (both-sides) emission by turned-off (5-2)-th and (6-2)-th transistors T5-2 and T6-2 and thus, the second organic light emitting diode OLED2 for the back-side (both-sides) emission may not emit the light.

Figure 6:
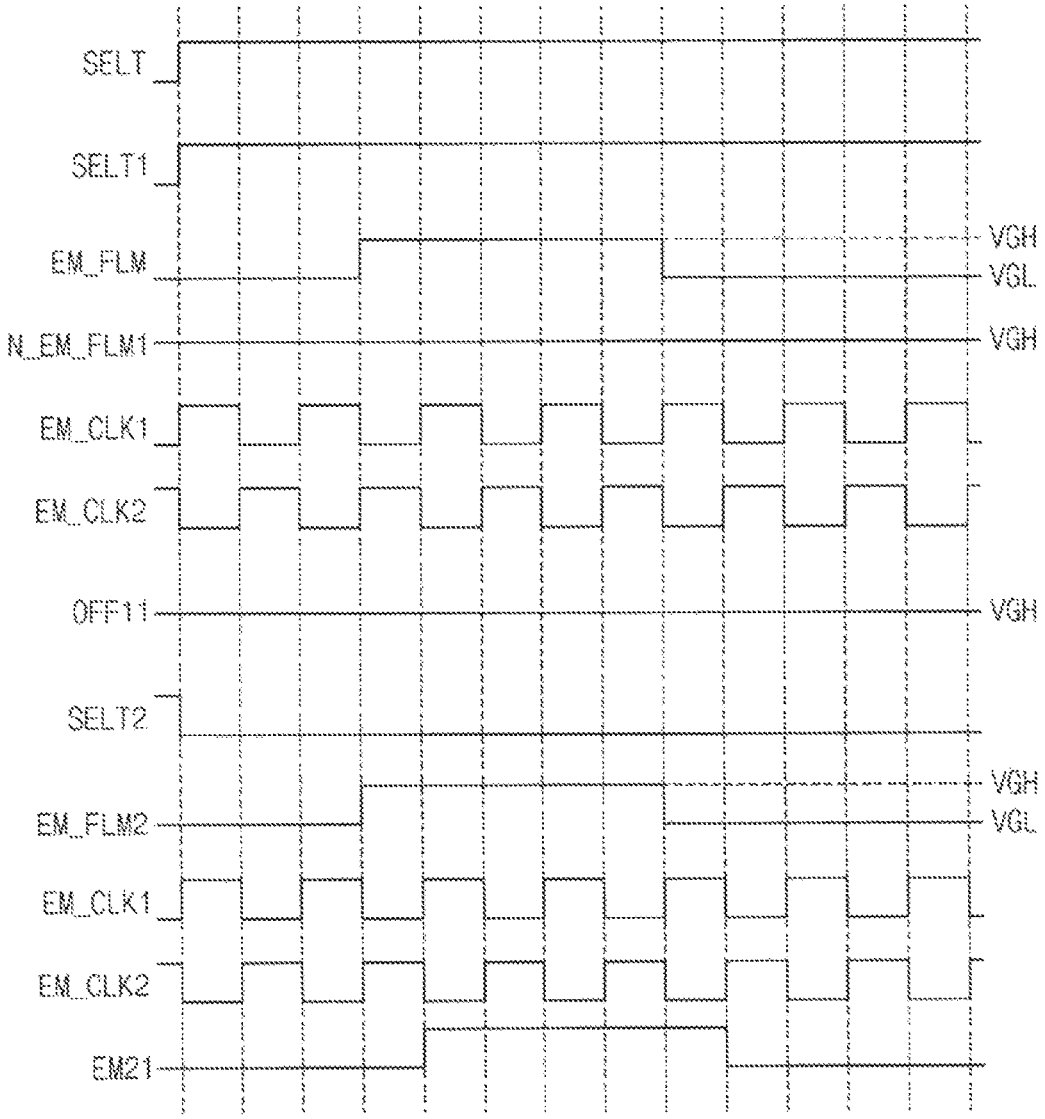
FIG. 6 is a timing chart illustrating a method of driving an emission driver in a back-side (both-sides) emission mode according to an exemplary embodiment.

FIG. 6 is a timing chart illustrating a method of driving an emission driver in a back-side (both-sides) emission mode according to an exemplary embodiment.

Referring to FIGS. 4 and 6, when the high level of the selecting signal SELT which does not select the front-side emission is received from the external device, the first selector 510 is configured to receive the high level of the first selecting signal SELT1 equal to the high level of the selecting signal SELT. The first selector 510 is configured to provide the first emission driver 410 with the high level VGH of the first no-emission start signal N_EM_FLM1 in response to the high level of the first selecting signal SELT1. The first emission driver 410 is configured to generate a plurality of first emission OFF signals OFF11, . . . having the high level VGH in response to the first no-emission start signal N_EM_FLM1 and to simultaneously output the plurality of first emission OFF signals OFF11, . . . to the plurality of first emission lines.

When the high level of the selecting signal SELT is received from the external device, the second selector 530 is configured to receive the low level of the second selecting signal SELT2 opposite to the high level of the selecting signal SELT. The second selector 530 is configured to provide the second emission driver 430 with the emission start signal EM_FLM received from the main driver 200 as the second emission start signal EM_FLM2 in response to the low level of the second selecting signal SELT2. The second emission driver 430 is configured to generate a plurality of second emission ON signals EM21, . . . in response to the second emission start signal EM_FLM2 and to sequentially output the plurality of second emission ON signals EM21, . . . to the plurality of second emission lines.

Referring to the pixel circuit shown in FIG. 2, the first emission OFF signal received from the first emission driver 410 is applied to the control electrodes of the (5-1)-th and (6-1)-th transistors T5-1 and T6-1. The second emission ON signal received from the second emission driver 430 is applied to the control electrodes of the (5-2)-th and (6-2)-th transistors T5-2 and T6-2. The (5-1)-th and (6-1)-th transistors T5-1 and T6-1 are turned off in response to the first emission OFF signal, and the (5-2)-th and (6-2)-th transistors T5-2 and T6-2 are turned on in response to the second emission ON signal.

Therefore, a driving current corresponding to the data voltage may not flow through the first organic light emitting diode OLED1 for the front-side emission by turned-off (5-1)-th and (6-1)-th transistors T5-1 and T6-1 and thus, the first organic light emitting diode OLED1 for the front-side emission may not emit the light. However, a driving current may flow through the second organic light emitting diode OLED2 for the back-side (both-sides) emission by turned-on (5-2)-th and (6-2)-th transistors T5-2 and T6-2 and thus, the second organic light emitting diode OLED2 for the back-side (both-sides) emission may emit the light.

According to the exemplary embodiment, the pixel circuit Pc may be configured to separately drive the front-side pixel P1 and the back-side (both-sides) pixel P2 of the pixel unit PU based on the selecting signal which is received from the external device and selects an emission-side.

Figure 7:
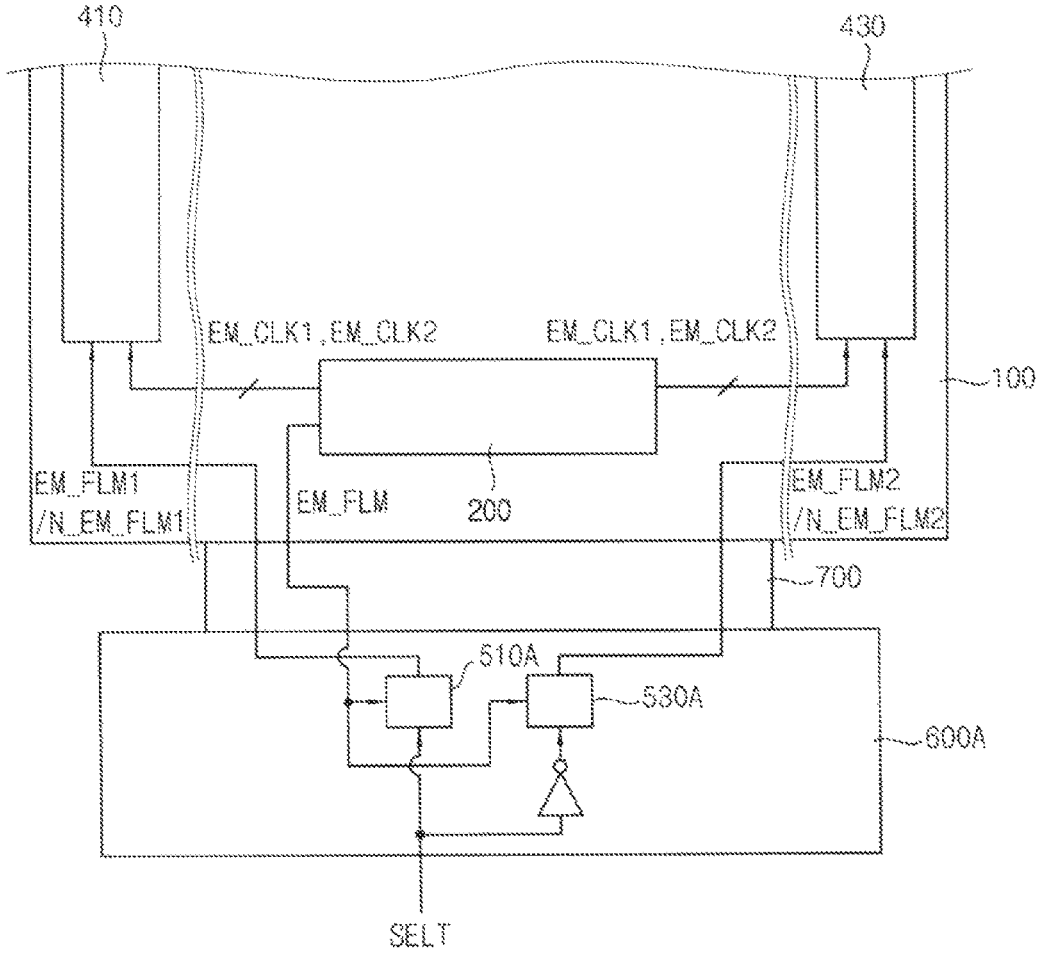
FIG. 7 is a conceptual diagram illustrating a display apparatus according to an exemplary embodiment.

FIG. 7 is a conceptual diagram illustrating a display apparatus according to an exemplary embodiment.

Referring to FIG. 7, the display apparatus may include a panel part 100, a main driver 200, a first emission driver 410, a second emission driver 430, a first selector 510A, a second selector 530A, a connection circuit board 600A and a connection circuit film 700.

The display apparatus according to the exemplary embodiment may include the first selector 510A, second selector 530A and connection circuit board 600A. In addition, display apparatus according to the exemplary embodiment may further include the same or like parts as those described in the display apparatus of the previous embodiment shown in FIG. 1. Hereinafter, the same reference numerals are used to refer to the same or like parts as those described in the previous exemplary embodiments, and the same detailed explanations are not repeated unless necessary.

According to the exemplary embodiment, the first selector 510A and the second selector 530A may include integrated electronic devices and may be disposed on the connection circuit board 600A.

The first selector 510A may include a first switch 511 and a first signal generator 512 as shown in FIG. 4.

As described in FIGS. 5 and 6, the first selector 510A may be configured to receive the emission start signal EM_FLM from the main driver 200, and may be configured to provide the first emission driver 410 with the emission start signal EM_FLM as the first emission start signal EM_FLM 1 according to the selecting signal SELT received from the external device.

The second selector 530A may include a second switch 531 and a second signal generator 532 as shown in FIG. 4. As described in FIGS. 5 and 6, the second selector 530A may be configured to receive the emission start signal EM_FLM from the main driver 200 and may be configured to provide the second emission driver 430 with the emission start signal EM_FLM as the second emission start signal EM_FLM 2 according to the selecting signal SELT received from the external device. In addition, the second selector 530A may be configured to provide the second emission driver 430 with the second no-emission start signal N_EM_FLM2 based on the selecting signal SELT.

Figure 8A:
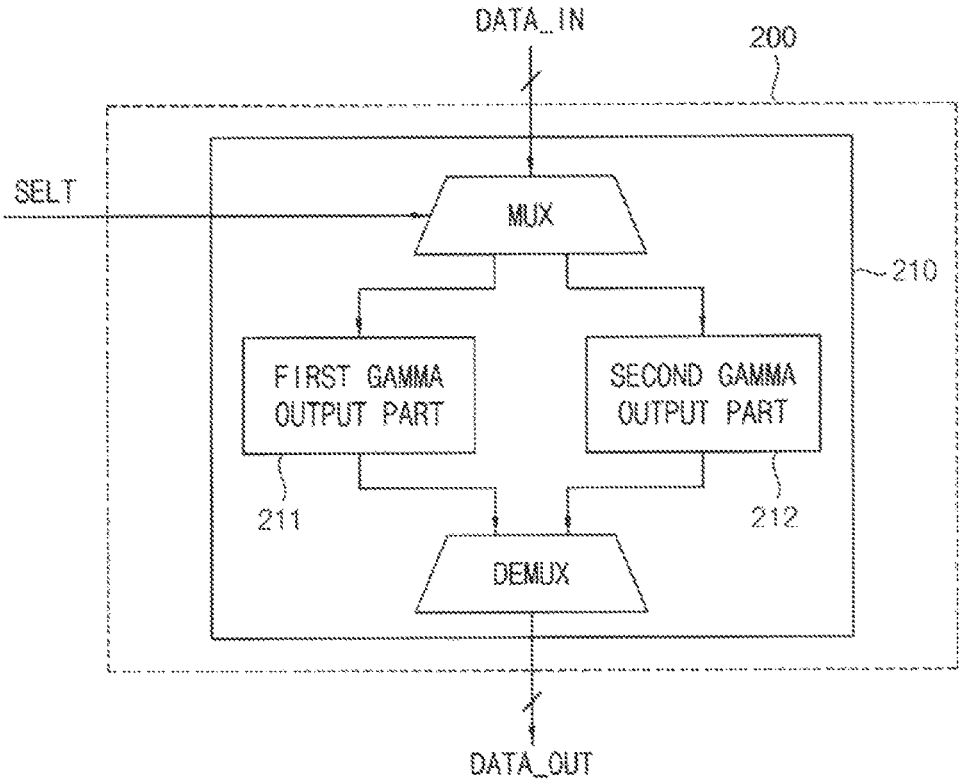
FIGS. 8A and 8B are a conceptual diagrams illustrating a main driver according to an exemplary embodiment.
Figure 8B:
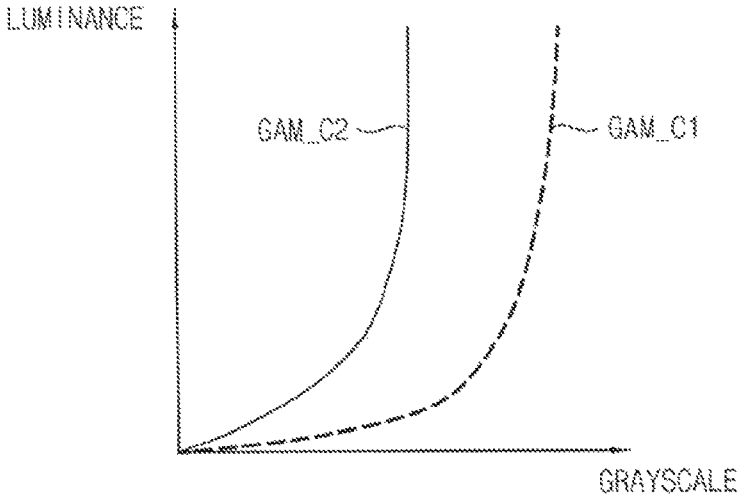

FIGS. 8A and 8B are conceptual diagrams illustrating a main driver according to an exemplary embodiment.

Referring to FIGS. 1, 8A and 8B, the main driver 200 may include a data driver 210. The data driver 210 may include a first gamma output part 211 and a second gamma output part 212.

The first gamma output part 211 may include a first resistor string which is configured to generate a plurality of first gamma data voltages based on a first gamma curve GAM_C1. The first gamma curve GAM_C1 may be a curve which represents a luminance according to a grayscale corresponding to a front-side emission mode.

The second gamma output part 212 may include a second resistor string which is configured to generate plurality of second gamma data voltages based on a second gamma curve GAM_C2. The second gamma curve GAM_C2 may be a curve which represents a luminance according to a grayscale corresponding to a back-side (both-sides) emission mode.

Generally, a luminance effectiveness of the front-side pixel may be about 70% and a luminance effectiveness of the back-side (both-sides) pixel may be about 26%. According to the luminance effectiveness, when a same data voltage is respectively applied to the front-side pixel and the back-side (both-sides) pixel, a luminance of the front-side pixel may be higher than that of the back-side (both-sides) pixel.

Thus, in accordance with the luminance effectiveness, the first gamma curve GMA_C1 for the front-side emission and the second gamma curve GMA_C2 for the back-side (both-sides) emission may be predetermined as shown in FIG. 8B. For example, the data voltage corresponding to the back-side (both-sides) pixel according to the second gamma curve GMA_C2 may have a high level higher than that of the data voltage corresponding to the front-side pixel according to the first gamma curve GMA_C1 and thus, a luminance difference between the front-side and back-side (both-sides) pixels may be eliminated.

The data driver 210 is configured to convert input data DATA_IN which is received from external device according to the selecting signal SELT, into a gamma data voltage through the first gamma output part 211 or the second gamma output part 212, and to output the gamma data voltage to a data line (DATA_OUT).

When the selecting signal SELT corresponds to a front-side emission mode, the first gamma output part 211 is configured to generate and output a first gamma data voltage corresponding to the input data DATA_IN through a first resistor string based on the first gamma curve GAM_C1 (DATA_OUT). However, when the selecting signal SELT corresponds to a back-side (both-sides) emission mode, the second gamma output part 212 is configured to generate and output a second gamma data voltage corresponding to the input data DATA_IN through a second resistor string based on the second gamma curve GAM_C2 (DATA_OUT). The first or second gamma data voltages may be outputted to a plurality of data lines arranged in the display part.

According to the exemplary embodiment, a gamma curve may be altered according to the front-side emission mode and the back-side (both-sides) emission mode, and thus a luminance in the front-side emission mode and luminance in the back-side (both-sides) emission mode may have equal value with respect to input data having a same grayscale. Therefore, a luminance difference between the front-side and back-side (both-sides) pixels may be eliminated.

Figure 9:
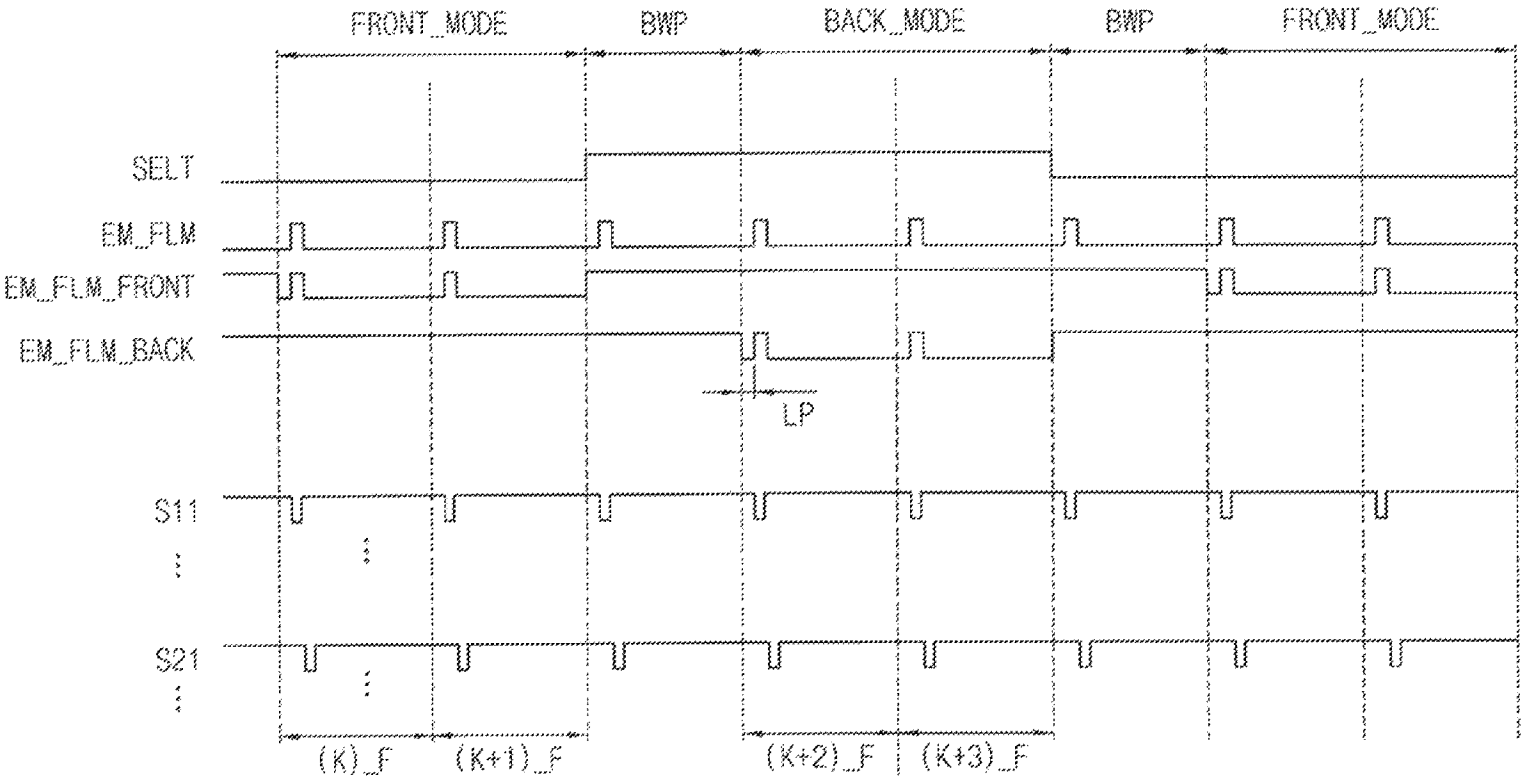
FIG. 9 is a timing chart illustrating a method of driving display apparatus according to an exemplary embodiment.

FIG. 9 is a timing chart illustrating a method of driving display apparatus according to an exemplary embodiment.

Referring to FIG. 9, according to the exemplary embodiment, a black write period BWP in which a black data voltage is applied to the front-side pixel and the back-side (both-sides) pixel, may be inserted between the front-side emission mode FRONT_MODE and the back-side (both-sides) emission mode BACK_MODE. Therefore, a crosstalk between images of previous and present emission modes may be avoided when the emission mode changes.

Referring to FIGS. 5 and 9, when the low level of the selecting signal SELT is received, the display apparatus may be driven with the front-side emission mode FRONT_MODE.

Referring to a K-th frame K_F to a (K+1)-th frame K+1_F corresponding to the front-side emission mode FRONT_MODE, the first selector 510 is configured to provide the first emission driver 410 with the first emission start signal EM_FLM1 equal to the emission start signal EM_FLM received from the main driver 200 according to the low level of the selecting signal SELT1.

The first emission driver 410 is configured to receive the first emission start signal EM_FLM1 (EM_FLM_Front). The first emission driver 410 is configured to sequentially output a plurality of first emission ON signals EM11, . . . .

However, the second selector 530 is configured to provide the second emission driver 430 with the high level VGH of the second no-emission start signal N_EM_FLM2 in response to the high level of the selecting signal SELT2.

The second emission driver 430 is configured to receive the second no-emission start signal N_EM_FLM2 (EM_FLM_Back). The second emission driver 430 is configured to sequentially output a plurality of second emission OFF signals OFF21, . . . having a high level.

During the black write period BWP during which the selecting signal is changed from the low level to high level after the (K+1)-th frame, the main driver 200 is configured to control the first selector 510 so that the first selector 510 is configured to provide the first emission driver 410 with the high level of the first no-emission start signal and to provide the second emission driver 430 with the high level of the second no-emission start signal.

The first emission driver 410 is configured to receive the high level of the first no-emission start signal (EM_FLM_Front), and the second emission driver 430 is configured to receive the high level of the second no-emission start signal (EM_FLM_Back).

During the black write period BWP, the main driver 200 is configured to control the first and second scan drivers 310 and 320 so that the first and second scan drivers 310 and 320 may be driven normally. The first scan driver 310 is configured to output a plurality of first scan signals S11, . . . . The second scan driver 330 is configured to output a plurality of second scan signals S21, . . . .

In addition, during the black write period BWP, the main driver 200 is configured to output the black data voltage to the plurality of data lines in the display part DA.

Referring to FIG. 3, during a first period a of the black write period BWP, previous data voltage charged in the capacitor CST of the pixel circuit during the front-side emission mode may be initialized by the initial voltage Vinit.

During a second period b of the black write period BWP, the threshold voltage of the first transistor T1 may be compensated, a voltage corresponding to the black data voltage applied to the data line DL may be charged in the capacitor CST, and the anode electrode may be initialized by the initial voltage Vinit.

However, during the black write period BWP, the (5-1)-th and (6-1)-th transistors T5-1 and T6-1 are turned off in response to the high level of the first emission OFF signal. The (5-2)-th and (6-2)-th transistors T5-2 and T6-2 are turned off in response to the high level of the second emission OFF signal. Therefore, during the black write period, the first and second organic light emitting diodes OLED1 and OLED2 may not emit the light and thus, may display a black image.

Then, when the black write period BWP is finished, the main driver 200 is configured to drive the display apparatus with the back-side (both-sides) emission mode BACK_MODE in response to the high level of the selecting signal.

Referring to FIGS. 6 and 9, referring to a (K+2)-th frame to a (K+3)-th frame K+2_F to K+3_F, the first selector 510 is configured to provide the first emission driver 410 with the high level of the first no-emission start signal N_EM_FLM1 in response to the high level of the selecting signal SELT1. The first emission driver 410 is configured to receive the first no-emission start signal N_EM_FLM21 (EM_FLM_Front). The first emission driver 410 is configured to output a plurality of first emission OFF signals OFF11, . . . having the high level.

However, the second selector 530 is configured to provide the second emission driver 430 with the second emission start signal EM_FLM2 equal to the emission start signal EM_FLM. The second emission driver 430 is configured to receive the second emission start signal EM_FLM2 (EM_FLM_Back). The second emission driver 410 is configured to sequentially output a plurality of first emission ON signals EM21, . . . .

Referring to the start signal EM_FLM_Back applied to the second emission driver 530, when the emission mode is changed into the back-side (both-sides) emission mode BACK_MODE in the black write period BWP, the start signal EM_FLM_Back may include a low period LP having the low level in as shown in FIG. 9. During the low period LP having the low level, a driving current may flow through the second organic light emitting diode for the back-side (both-sides) emission. According to the exemplary embodiment, the black data voltage is charged in the pixel circuit since the black write period BWP and thus, the driving current corresponding to the black data voltage may flow through the second organic light emitting diode for the back-side (both-sides) emission. Therefore, the back-side (both-sides) pixel may display the black image during the low period LT and a crosstalk between images of previous and present emission modes may be avoided.

As described above, when the emission mode is changed from the back-side (both-sides) emission mode BACK_MODE to the front-side emission mode FRONT_MODE in the black write period BWP, the black write period BWP is inserted between the back-side (both-sides) emission mode BACK_MODE and the front-side emission mode FRONT_MODE so that a crosstalk between images of previous and present emission modes may be avoided.

Figure 10:
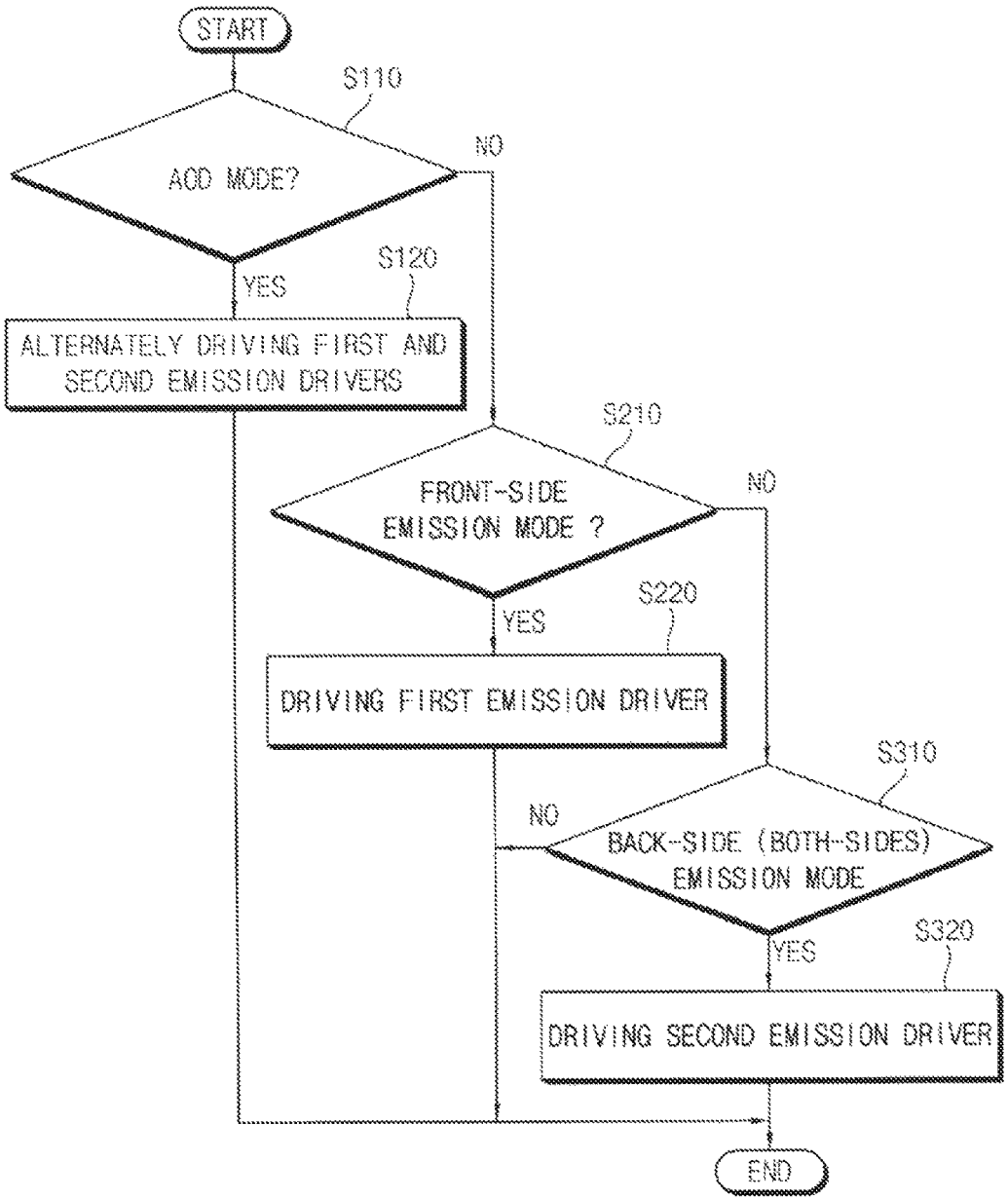
FIG. 10 is a flowchart illustrating a method of driving display apparatus according to an exemplary embodiment.
Figure 11:
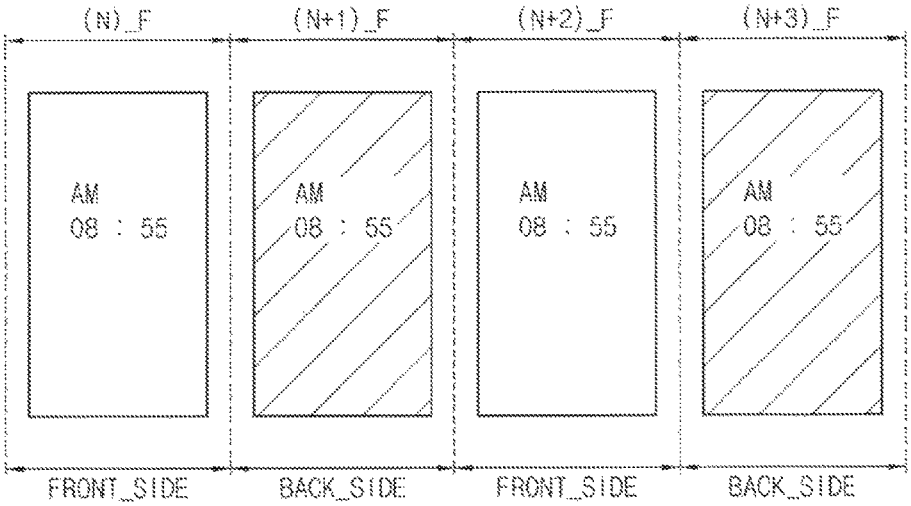
FIG. 11 is a timing chart illustrating a method of driving display apparatus according to an exemplary embodiment.

FIG. 10 is a flowchart illustrating a method of driving display apparatus according to an exemplary embodiment. FIG. 11 is a timing chart illustrating a method of driving display apparatus according to an exemplary embodiment.

According to the exemplary embodiment, the display apparatus is configured to alternately drive the first emission driver for the front-side emission and the second emission driver for back-side (both-sides) emission by a predetermined period so that a standby image for the always on display (AOD) mode may be alternately displayed on the front-side pixel and the back-side (both-sides) pixel (Step S120).

The AOD mode is a standby mode in which the display apparatus is driven with a low power and always displays a preset standby image such as a watch image, a weather image, a date image, etc.

Referring to FIGS. 1, 10 and 11, the main driver 200 of the display apparatus is configured to receive an AOD mode signal corresponding to the AOD mode from the external device.

When the AOD mode signal is received 5110, the main driver 200 is configured to alternately drive the first emission driver for the front-side emission and the second emission driver for back-side (both-sides) emission by a predetermined period.

For example, during an N-th frame N_F, the main driver 200 is configured to control the first selector 510 so that the first selector 510 is configured to provide the first emission driver 410 with a first emission start signal. The main driver 200 is configured to control the second selector 530 so that the second selector 530 is configured to provide the second emission driver 430 with the second no-emission start signal.

During the N-th frame N_F, the first emission driver 410 is configured to sequentially output a plurality of first emission ON signals to the plurality of first emission lines. The second emission driver 430 is configured to simultaneously output a plurality of emission OFF signals to the plurality of second emission lines.

During the N-th frame N_F, the first organic light emitting diode OLED1 of the front-side pixel P1 is configured to receive an emission ON signal and the second organic light emitting diode OLED2 of the back-side (both-sides) pixel P2 is configured to receive an emission OFF signal. Therefore, the standby image for the AOD mode may be displayed on the front-side pixel P1.

During an (N+1)-th frame N+1_F, the main driver 200 is configured to control the second selector 530 so that the second selector 530 is configured to provide the second emission driver 430 with the second emission start signal. However, the main driver 200 is configured to control the first selector 510 so that the first selector 510 is configured to provide the first emission driver 410 with the first no-emission start signal.

During the (N+1)-th frame N+1_F, the second emission driver 430 is configured to sequentially output a plurality of second emission ON signals to the plurality of second emission lines. The first emission driver 410 is configured to simultaneously output a plurality of emission OFF signals to the plurality of first emission lines.

During the (N+1)-th frame N+1_F, the second organic light emitting diode OLED2 of the back-side (both-sides) pixel P2 is configured to receive the emission ON signal, and the first organic light emitting diode OLED1 of the front-side pixel P1 is configured to receive the emission OFF signal. Therefore, the standby image for the AOD mode may be displayed on the back-side (both-sides) pixel P2.

As described above, the standby image for the AOD mode may be displayed on the front-side pixel P1 during an (N+2)-th frame N+2_F and, the standby image for the AOD mode may be displayed on the back-side (both-sides) pixel P2 during an (N+3)-th frame N+3_F (Step S120).

According to the exemplary embodiment, in the AOD mode, the standby image may be alternately displayed on the front-side pixel and the back-side (both-sides) pixel by the predetermined period and thus, an afterimage may be eliminated. As shown in FIG. 11, the predetermined period may be a single frame, but not limited thereto. The predetermined period may be predetermined to have multi-frames, for example, two consecutive frames, three consecutive frames and so on.

However, in a normal mode, the emission start signal and the no-emission start signal may are selectively applied to the first emission driver and the second emission driver according to the selecting signal received from the external device as those described in the previous embodiment.

For example, when the selecting signal for the front-side emission is receive (Step S210), the first emission start signal is applied to the first emission driver and the second no-emission start signal is applied to the second emission driver. Thus, the first emission driver is configured to output a plurality of first emission ON signals to the plurality of first emission lines, and the second emission driver is configured to output a plurality of second emission OFF signals to the plurality of second emission lines (Step S220)

However, when the selecting signal for the back-side (both-sides) emission (Step S310), the second emission start signal is applied to the second emission driver and the second no-emission start signal is applied to the first emission driver. Thus, the second emission driver may be configured to output a plurality of second emission ON signals to the plurality of second emission lines, and the first emission driver may be configured to output a plurality of first emission OFF signals to the plurality of first emission lines (Step S320)

According to the exemplary embodiments, the display apparatus may separately drive the pixels for the front-side emission and the back-side (both-sides) emission according to the selecting signal. In addition, a gamma curve may be altered according to the front-side emission mode and the back-side (both-sides) emission mode, and thus luminance of a front-side image and a back-side (both-sides) image may be improved. In addition, the black write period may be inserted between the front-side and back-side (both-sides) emission modes, and thus, the crosstalk between the front-side and back-side (both-sides) images may be avoided. In addition, in the AOD mode, the front-side emission mode and the back-side (both-sides) emission mode are alternately driven by the predetermined period and thus, the afterimage may be eliminated.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus comprising:

a display part comprising a first organic light emitting diode for a front-side emission, a second organic light emitting diode for a back-side emission, and a pixel circuit configured to drive the first and second organic light emitting diodes;

a first emission driver configured to generate a first emission ON signal and a first emission OFF signal to turn-on and turn-off the first organic light emitting diode;

a second emission driver configured to generate a second emission ON signal and a second emission OFF signal to turn-on and turn-off the second organic light emitting diode;

a first selector configured to selectively output a first emission start signal and a first no-emission start signal to the first emission driver according to a selecting signal; and a second selector configured to selectively output a second emission start signal and a second no-emission start signal to the second emission driver according to the selecting signal, wherein the first emission driver is configured to provide a first emission line of the pixel circuit with a first emission OFF signal in response to the first no-emission start signal, and the second emission driver is configured to provide a second emission line of the pixel circuit with a second emission OFF signal in response to the second no-emission start signal, during a black write period between a front-side emission mode and a back-side emission mode.

2. The display apparatus of claim 1, wherein the display part further comprises a transmission part transmitting a light.

3. The display apparatus of claim 1, wherein the first selector is configured to provide the first emission driver with a first emission start signal, the second selector is configured to provide the second emission driver with the second no-emission start signal, the first emission driver is configured to provide the first emission line of the pixel circuit with the first emission ON signal corresponding to the first emission start signal, and the second emission driver is configured to provide the second emission line of the pixel circuit with the second emission OFF signal corresponding to the second no-emission start signal, in response to the selecting signal for the front-side emission.

4. The display apparatus of claim 1, wherein the first selector is configured to provide the first emission driver with the first no-emission start signal, the second selector is configured to provide the second emission driver with a second emission start signal, the first emission driver is configured to provide the first emission line of the pixel circuit with the first emission OFF signal corresponding to the first no-emission start signal, and the second emission driver is configured to provide the second emission line of the pixel circuit with the second emission ON signal corresponding to the second emission start signal, in response to the selecting signal for the back-side emission.

5. The display apparatus of claim 4, wherein the first and second no-emission start signal are direct current signals having a predetermined level and, the first and second emission OFF signals are direct current signals having the predetermined level.

6. The display apparatus of claim 1, wherein each of the first and second emission drivers comprises a plurality of stages, the first selector is disposed between a first stage of the first emission driver and a selecting signal line, and the second selector is disposed between a first stage of the second emission driver and the selecting signal line.

7. The display apparatus of claim 6, further comprising:

a peripheral part surrounding the display part, the first and second emission drivers being disposed in the peripheral part, and a panel part comprising the display part and the peripheral part, wherein the first selector is disposed in the peripheral part adjacent to the first emission driver and the second selector is disposed in the peripheral part adjacent to the second emission driver.

8. The display apparatus of claim 6, further comprising:

a peripheral part surrounding the display part and a panel part comprising the display part and the peripheral part, and a connection circuit board connected to the panel part through a connection circuit film, wherein the first and second selectors are disposed on the connection circuit board.

9. The display apparatus of claim 1, further comprising:

a main driver configured to provide the first and second selectors with an emission start signal, wherein the first and second emission start signals which are equal to the emission start signal are respectively applied to the first and second emission drivers according to the selecting signal.

10. The display apparatus of claim 9, wherein the main driver comprises a first gamma output part configured to output gamma data for the front-side emission, and a second gamma output part configured to output gamma data for the back-side emission, wherein the main driver is configured to output gamma data corresponding to input data for the front-side or back-side emission using the first or second gamma output part.

11. The display apparatus of claim 1, wherein a main driver is configured to provide a data line of the pixel circuit with a black data voltage during the black write period.

12. The display apparatus of claim 1, wherein the black write period comprises at least one frame.

13. The display apparatus of claim 1, wherein the first emission driver is configured to provide the first emission line of the pixel circuit with the first emission ON signal in response to a first emission start signal and the second emission driver is configured to provide the second emission line of the pixel circuit with the second emission ON signal in response to a second emission start signal, during a first period, wherein the first emission driver is configured to provide the first emission line of the pixel circuit with the first emission OFF signal in response to the first no-emission start signal and the second emission driver is configured to provide the second emission line of the pixel circuit with the second emission OFF signal in response to the second no-emission start signal, during a second period, and wherein the first period alternates with the second period in an AOD (Always On Display) mode.

14. The display apparatus of claim 13, wherein each of the first and second periods corresponds to a single frame.

15. The display apparatus of claim 1, wherein the pixel circuit comprises:

a first transistor comprising a control electrode connected to a first node, a first electrode connected to a second node and a second electrode connected to a third node;

a capacitor comprising a first electrode connected to a first voltage line and a second electrode connected to the first node;

a second transistor comprising a control electrode connected to a first scan line, a first electrode connected to a data line and a second electrode connected to the second node;

a third transistor comprising a control electrode connected to the first scan line, a first electrode connected to the first node and a second electrode connected to the third node;

a (5-1)-th transistor comprising a control electrode connected to the first emission line of the pixel circuit, a first electrode connected to the first voltage line and a second electrode connected to the second node;

a (6-1)-th transistor comprising a control electrode connected to the first emission line of the pixel circuit, a first electrode connected to the third node and a second electrode connected to an anode electrode of the first organic light emitting diode; and a (6-2)-th transistor comprising a control electrode connected to the second emission line, a first electrode connected to the third node and a second electrode connected to an anode electrode of the second organic light emitting diode.

16. The display apparatus of claim 15, wherein the pixel circuit further comprises:

a (5-2)-th transistor comprising a control electrode connected to the second emission line, a first electrode connected to the first voltage line and a second electrode connected to the second node.

17. The display apparatus of claim 16, wherein the pixel circuit further comprises:

a (7-1)-th transistor comprising a control electrode connected to the first scan line, a first electrode connected to a second voltage line and a second electrode connected to the anode electrode of the first organic light emitting diode; and a (7-2)-th transistor comprising a control electrode connected to the first scan line, a first electrode connected to the second voltage line and a second electrode connected to the anode electrode of the second organic light emitting diode.

18. The display apparatus of claim 17, wherein the pixel circuit further comprises:

a fourth transistor comprising a control electrode connected to a second scan line, a first electrode connected to the first node and a second electrode connected to the second voltage line.

19. The display apparatus of claim 18, wherein the (5-1)-th and (6-1)-th transistors turn on and turn off in response to the first emission ON signal and a first emission OFF signal generated from the first emission driver.

20. The display apparatus of claim 18, wherein the (5-2)-th and (6-2)-th transistors turn on and turn off in response to the second emission ON signal and the second emission OFF signal generated from the second emission driver.

* * * * *